US012692710B2

(12) United States Patent
Huang et al.

(10) Patent No.: US 12,692,710 B2
(45) Date of Patent: Jul. 28, 2026

(54) SUPPORT DEVICE FOR COMPOSITE ELEVATED FLOOR

(71) Applicant: VERO VERIA CORPORATION, Taipei (TW)

(72) Inventors: Chien-Teh Huang, Taipei (TW); Ke-Ming Wang, Shanghai (CN)

(73) Assignee: VERO VERIA CORPORATION, Taipei (TW)

( * ) Notice: Subject to any disclaimer, the term of this patent is extended or adjusted under 35 U.S.C. 154(b) by 136 days.

(21) Appl. No.: 18/766,692

(22) Filed: Jul. 9, 2024

(65) Prior Publication Data

US 2025/0305299 A1 Oct. 2, 2025

(30) Foreign Application Priority Data

Apr. 1, 2024 (TW) ..... 113112303

(51) Int. Cl.
*E04F 15/024* (2006.01)

(52) U.S. Cl.
CPC .. *E04F 15/02452* (2013.01); *E04F 15/02458* (2013.01)

(58) Field of Classification Search
CPC ..... E04F 15/024; E04F 15/02477; E04F 15/02452; E04F 15/02458; E04F 15/02464; E04F 15/0247; E04F 15/02476; E04F 15/02494; H02G 3/285; H02G 3/385
USPC ..... 52/263
See application file for complete search history.

(56) References Cited

U.S. PATENT DOCUMENTS 3,861,098 A * 1/1975 Schaub ..... E04D 11/005 52/263
4,685,258 A * 8/1987 Av-Zuk ..... E04F 15/02452 52/126.6
4,996,804 A * 3/1991 Naka ..... E04F 15/02482 52/126.6
2005/0166483 A1* 8/2005 Mead ..... E04F 15/02452 52/126.7
2008/0141601 A1* 6/2008 Mead ..... E04F 15/02452 52/126.6

(Continued)

FOREIGN PATENT DOCUMENTS

CN 117287008 A * 12/2023 ..... E04F 15/0247
EP 0362718 A1 * 4/1990 ..... E04F 15/02452
EP 2196597 A1 * 6/2010 ..... E04F 15/0247

(Continued)

*Primary Examiner* — Kyle J. Walraed-Sullivan
(74) *Attorney, Agent, or Firm* — WPAT, PC

(57) ABSTRACT

A support device for a composite elevated floor is provided by the present invention. The support device for the composite elevated floor comprises that of: at least one support base assembly, a plurality of crossbeams, and a plurality of first-type floors. The at least one support base assembly has a base and at least two first connectors, the first connectors are respectively disposed at peripheral of the base, a surface of the first connector is lower than a surface of the base; the plurality of crossbeams are connected with each of the support base assemblies, wherein the plurality of the first connectors are connected with the corresponding crossbeams respectively; and the plurality of first-type floors, wherein four corners of each of the first-type floors are a groove respectively, the grooves bears the corresponding surfaces of the bases.

11 Claims, 12 Drawing Sheets

(56) References Cited

U.S. PATENT DOCUMENTS

| | | | | |
|---|---|---|---|---|
| 2010/0205874 | A1* | 8/2010 | Zlatar | E04F 15/02452<br>52/126.6 |
| 2024/0044150 | A1* | 2/2024 | Cipriani | E04F 15/02447 |

FOREIGN PATENT DOCUMENTS

| | | | | |
|---|---|---|---|---|
| GB | 2599361 | A * | 4/2022 | E04F 15/024 |
| WO | WO-2007048204 | A1 * | 5/2007 | E04F 15/02482 |

* cited by examiner

SUPPORT DEVICE FOR COMPOSITE ELEVATED FLOOR

CROSS REFERENCE TO RELATED APPLICATION

This application claims the benefits of Taiwan application Serial No. 113112303, filed on Apr. 1, 2024, the disclosures of which are incorporated by references herein in its entirety.

TECHNICAL FIELD

The present invention is in related to a support device, more particularly to a support device for a composite elevated floor.

BACKGROUND

The present raised floors are primarily assembled from pedestals, crossbeams, and floor panels, and can be installed in high-tech factories, buildings, or offices. The current technology of raised floors mainly applies a plurality of pedestals to support floor panels on the ground, in order to let electrical wires, network cables, etc., and other related lines be laid and hidden in a space between the ground and the raised floor, so as to keep the neatness and aesthetics of the interior space in high-tech factories, buildings, or offices.

The other application of the raised floor is for clean rooms in high-tech factories. That is to say, air that has been treated at the top of the cleanroom is vertically directed into the return air duct below the raised floor, a vertical airflow is thus formed within the cleanroom, so as to maintain clean air.

Besides, depending on the demands of environments, the raised floor can be chosen with different weights or materials for constructing. For example, if machines need to be installed in a high-tech factory, a heavier-loading floor can be mounted on the ground corresponding to the position of the machines; on the contrary, other positions for lighter weight can be used with light-weight floors, in order to decrease the cost of assembly and the overall weight.

However, the floors with different weights may also be differed from thicknesses. Traditionally, the raised floors are applied with consistent height pedestals, in order to maintain the flatness of the raised floors after assembly. Hence, how to maintain the flatness of the surface of the raised floor after assembling floors with different weights or thicknesses, so as to avoid the uneven surface from affecting the movement of people on the raised floor and the convenience and safety of transporting items.

SUMMARY

The embodiment of the present invention provides a support device for a composite elevated floor, which can be flexibly used to assemble floors with different thicknesses through a support base assembly.

The embodiment of the present invention provides a support device for a composite elevated floor comprises that of: at least one support base assembly, a plurality of crossbeams, and a plurality of first-type floors. The at least one support base assembly has a base and at least two first connectors, the first connectors are respectively disposed at peripheral of the base, a surface of the first connector is lower than a surface of the base; the plurality of crossbeams are connected with each of the support base assemblies, wherein the plurality of the first connectors are connected with the corresponding crossbeams respectively; and the plurality of first-type floors, wherein four corners of each of the first-type floors are a groove respectively, the groove bears the corresponding surface of the base.

In one embodiment, the at least one support base assembly comprises at least one positioning member, which protrudes out from the surface of the base, the at least one positioning member positions the first-type floor.

In one embodiment, the at least one support base assembly comprises a plurality of floor fixing holes, which respectively penetrate through the base, the at least one positioning member is adjacent to the corresponding floor fixing hole.

In one embodiment, the at least one support base assembly comprises a central hole and a screw rod, the central hole (118) penetrates through the base, the floor fixing holes are located at peripheral of the central hole respectively, one end of is inserted into the central hole and disposed at a bottom portion of the base.

In one embodiment, the at least one support base assembly comprises at least one second connector and at least one open slot, the at least one second connector is disposed in the base, the plural second connectors are connected with the corresponding crossbeams respectively, one surface of the at least one second connector is lower than the surface of the base and higher than the surface of the first connector, the at least one open slot is disposed at the base, the at least one second connector is disposed in the corresponding open slot.

In one embodiment, the support device for the composite elevated floor further comprises a plurality of second-type floors in a second area, wherein the plurality of first-type floors are disposed in a first area, four corners of each of the second-type floors respectively bear a standard support bases, the second area is disposed at peripheral of the first area.

In one embodiment, the at least one support base assembly comprises a first-type support base, which bears one of four corners of the first-type floor, the first-type support base has the base and the four first connectors, the four first connectors are connected with the peripheral of the base.

In one embodiment, the first-type support base comprises four positioning members, which respectively protrude out from the surface of the base.

In one embodiment, the at least one support base assembly comprises a second-type support base, which bears one corner of each of the two first-type floors and one corner of each of the two second-type floors, the second-type support base has the base, the three first connectors, a second connector, and an open slot, the open slot is disposed at the base, the second connector is disposed in the base and the open slot, the three first connectors are respectively connected with the peripheral of the base.

In one embodiment, the second-type support base comprises two positioning members, which respectively protrude out from the surface of the base.

In one embodiment, the at least one support base assembly comprises a third-type support base, which bears one corner of the first-type floor and one corner of each of the three second-type floors, the third-type support base has the base, the two first connectors, two second connectors, and two open slots, the open slots are respectively disposed at the base, the two second connectors are respectively disposed in the base, further the two second connectors are respectively disposed in the two corresponding open slots, the two first connectors are respectively connected with the peripheral of the base.

In one embodiment, the third support base comprises a positioning member, which protrudes out from the surface of the base.

In one embodiment, the at least one support base assembly is disposed on a bottom base which has a stand tube member, a pipe cover, a screw set, a locking hole, and a locking accessory, the stand tube member is a hollow tube with an opening, one end of a screw rod of the support base assembly is sequentially inserted into an internal threaded hole of the pipe cover and an inside of the stand tube member.

As aforementioned, the support base assembly of the present invention can be equipped with connecters and positioning members with different heights according to the different floor structures (such as thickness) to be supported, so that it can be flexibly applied to assemble a support device for a composite elevated floor.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
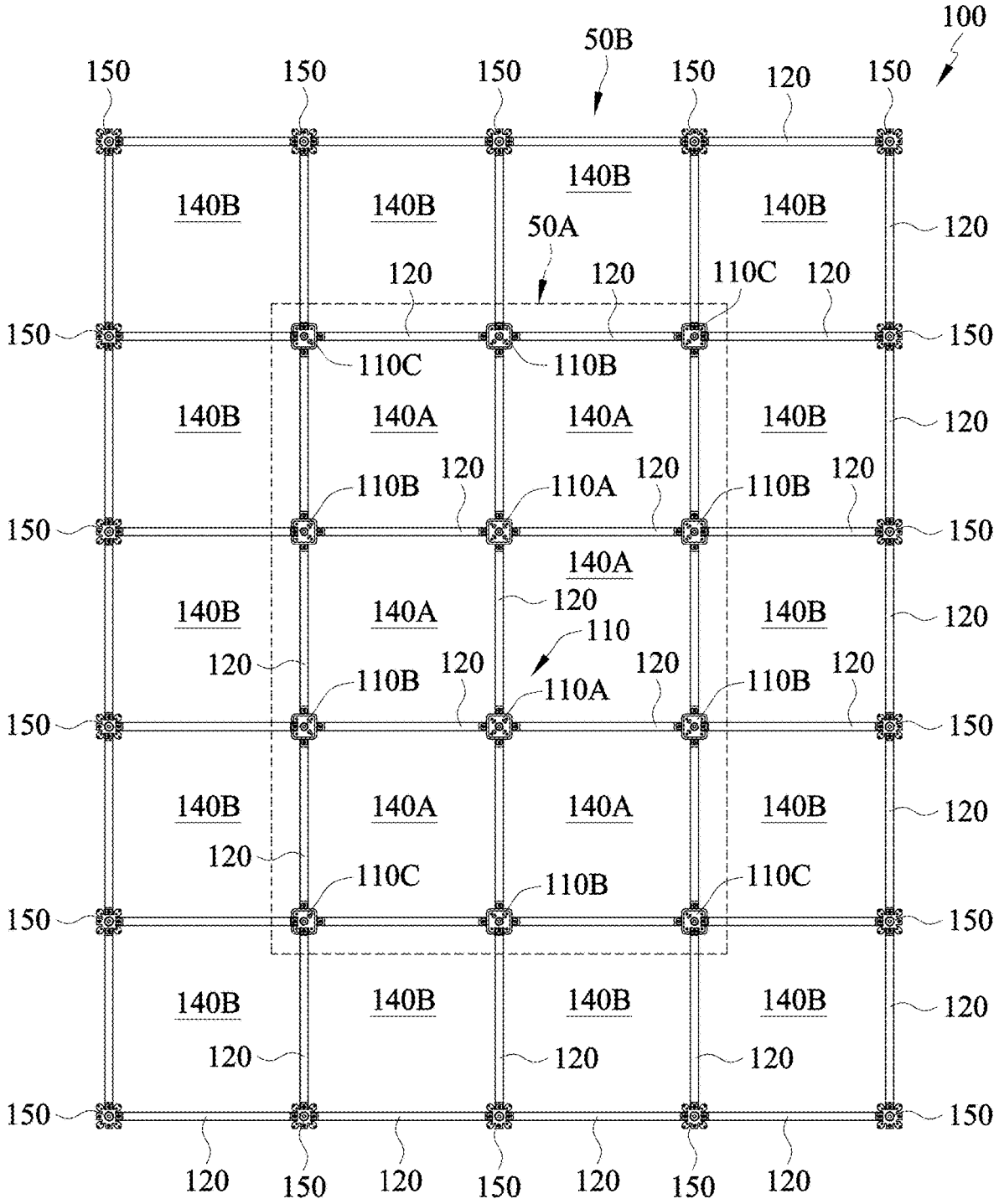
FIG. 1 illustrates a schematic top view of a preferred embodiment of a support device for a composite elevated floor of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The terms "including", "comprising", "having" and the like mentioned in this disclosure are all open terms; i.e., implying only "including but not limited to".

In the description of embodiments, when terms such as "first", "second", "third", "fourth" etc. are used to describe elements, they are only used to distinguish these elements from each other, but not limit order or importance of any of these elements.

In the descriptions of various embodiments, the so-called "coupling" or "connection" may refer to two or a plurality of components making physical or electrical contact directly or indirectly with each other, or refer to the mutual operation or action of two or a plurality of elements.

FIG. 1 illustrates a schematic top view of a preferred embodiment of a support device for a composite elevated floor of the present invention. As shown in FIG. 1, a support device 100 for a composite elevated floor can be used in high-tech factories, buildings, or offices. The support device 100 has a plurality of first-type support bases 110A, a plurality of second-type support bases 110B, a plurality of third-type support bases 110C, a plurality of standard support bases 150, a plurality of support base assemblies 110, a plurality of crossbeams 120, a plurality of first-type floors 140A, and a plurality of second-type floors 140B. In practice, according to different process equipment in actual high-tech factories, buildings, or offices, the support device 100 can be divided into two areas, which are a first area 50A and a second area 50B.

With reference to FIG. 1, which illustrates the support device 100 for the composite elevated floor disposed in a high-tech factory. The machine can be placed on the first area 50A, and the second area 50B is located around the first area 50A. The second area 50B can, for example, be used for transporting items or for operators to move around. The first-type floors 140A are provided in the first area 50A, and the second-type floors 140B are provided in the second area 50B. For instance, the first-type floor 140A is type 3000, which can carry process equipment of more than 3,000 kilograms to support the weight of the machine; the second-type floor 140B is type 1500, which can carry a load of more than 1,500 kilograms. The weight or thickness of the first-type floor 140A is larger than the weight or thickness (feet height) of the second-type floor 140B. As a matter of fact, the thickness (feet height) of the first-type floor 140A is more than 72 mm, and the thickness (feet height) of the second-type floor 140B is more than 56 mm.

The first-type support base 110A, the second-type support base 110B and the third-type support base 110C are located in the first area 50A. The first-type support base 110A, the second-type support base 110B and the third-type support base 110C are respectively connected with the four crossbeams 120. That is, the crossbeams 120 are used to connected with the plurality of support base assemblies 110. The first-type floors 140A are placed around the first-type support base 110A, and the first-type support base 110A bears one corner of each of the four first-type floors 140A. The second type support base 110B is surrounded by the two side-by-side first-type floors 140A and the two side-by-side second-type floors 140B. The second-type support base 110B respectively bears one corner of each of the two first-type floors 140A and one corner of each of the two second-type floor 140B. The third-type support base 110C is surround by the three second-type floors 140B and the first-type floor 140A, and the third-type support base 110C bears respectively one corner of the first-type floor 140A and one corner of each of the three second-type floors 140B. Since the third-type support base 110C and the second-type support base 110B are located at the internal border of the first area 50A and the second area 50B, the third-type support base 110C simultaneously supports the first-type floor 140A and the second-type floor 140B.

Additionally, the standard support base 150 is located outside the second area 50B. Any one corner of each of the four second-type floors 140B is supported by the standard support base 150.

Figure 2:
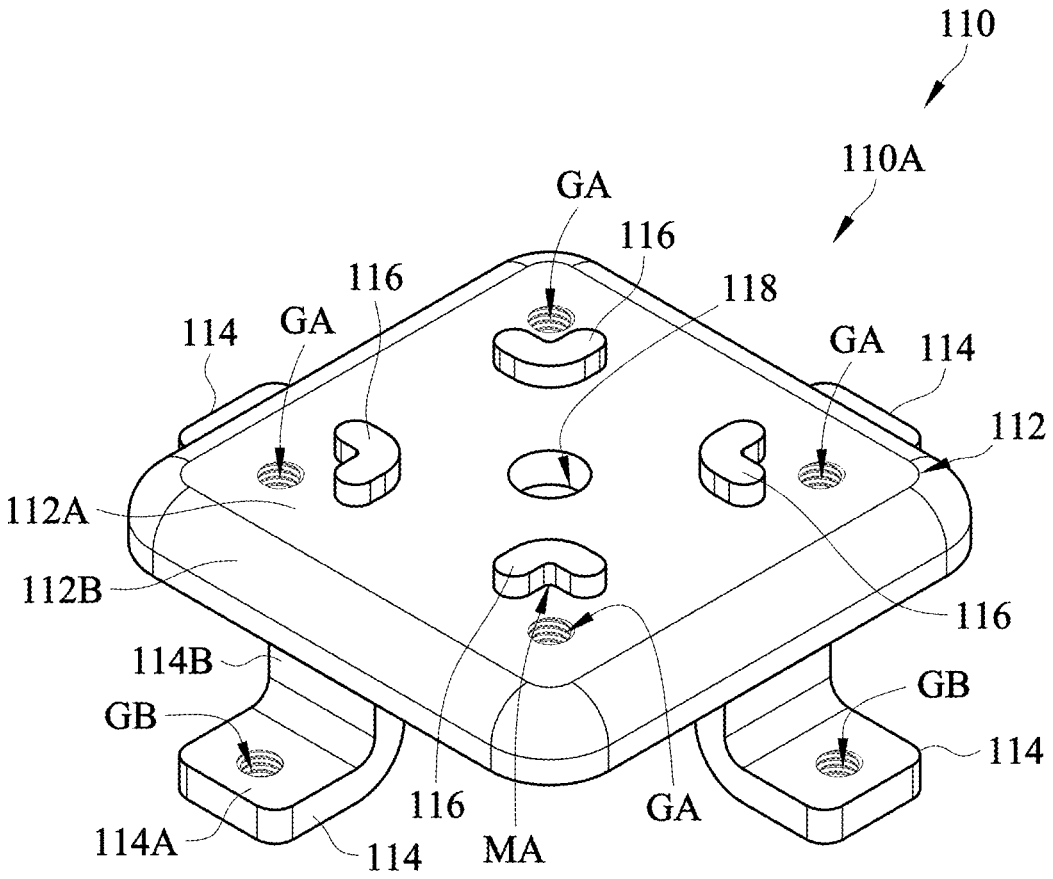
FIG. 2 illustrates a schematic 3-D view of a first-type support base of the present invention.
Figure 3:
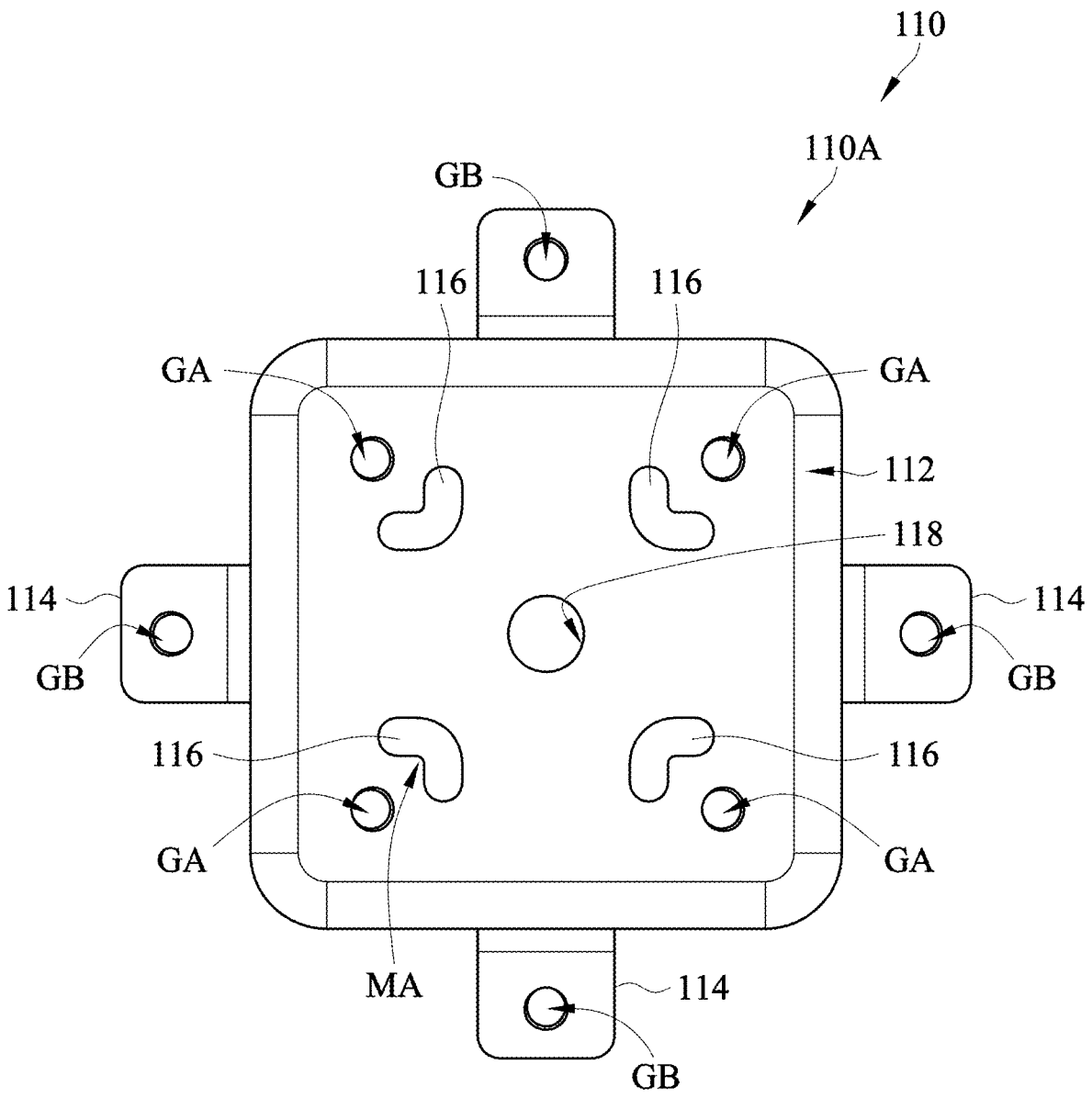
FIG. 3 illustrates a schematic top view of the first-type support base of the present invention.

In practice, as shown in FIG. 2 and FIG. 3, the first-type support base 110A of the support base assembly 110 includes a base 112, four first connectors 114, four positioning members 116, four floor fixing holes GA, four crossbeam fixing hole GB, and a central hole 118. The base 112 is a rectangular, and includes a surface 112A and an extending surface 112B that is connected with and surrounds the surface 112A and elongated downward. The central hole 118 is located at a central position of the surface 112A of the base 112, and penetrates through the base 112. The four floor fixing holes GA are equidistant from the center of the central hole 118 respectively, and penetrate through the base 112 at four locations, so that the four floor fixing holes GA surround the central hole 118. More, the four floor fixing holes GA are penetrating holes to go through the base 112. The four positioning members 116 individually protrude out from the surface 112A of the base 112, and are adjacent to the corresponding floor fixing hole (GA). Each of the positioning members 116 is to position the first-type floor 140A. As an example, the positioning member 116 has a recess MA, which is provided to bear the first-type floor 140A, as shown in FIG. 1. Hence, the four first-type floors 140A, as shown in FIG. 1, bear individually the corresponding four recesses MA of the positioning members 116. Further, through the floor fixing holes GA, the first-type floors 140A are thus positioned.

The four first connectors 114 are individually connected with the peripheral of the base 112 (such as around the base 112), and a surface 114A of each of the four first connectors 114 is lower than the surface 112A (shown in FIG. 2) of the base 112. Each of the first connectors 114 has a crossbeam fixing hole GB that is provided for the penetration and fixation of the cross beam 120. For example, the first connector 114 includes the surface 114A and a connecting portion 114B. The connecting portion 114B is connected with the extending surface 112B and the surface 114A, wherein the connecting portion 114B elongates a distance from the bottom portion of the extending surface 112B, the surface 114A elongates a distance from one end of the connecting portion 114B, and an elongation direction for the surface 114A is different from an elongation direction for the connecting portion 114B. Further, those two elongation directions are perpendicular to each other.

Figure 4:
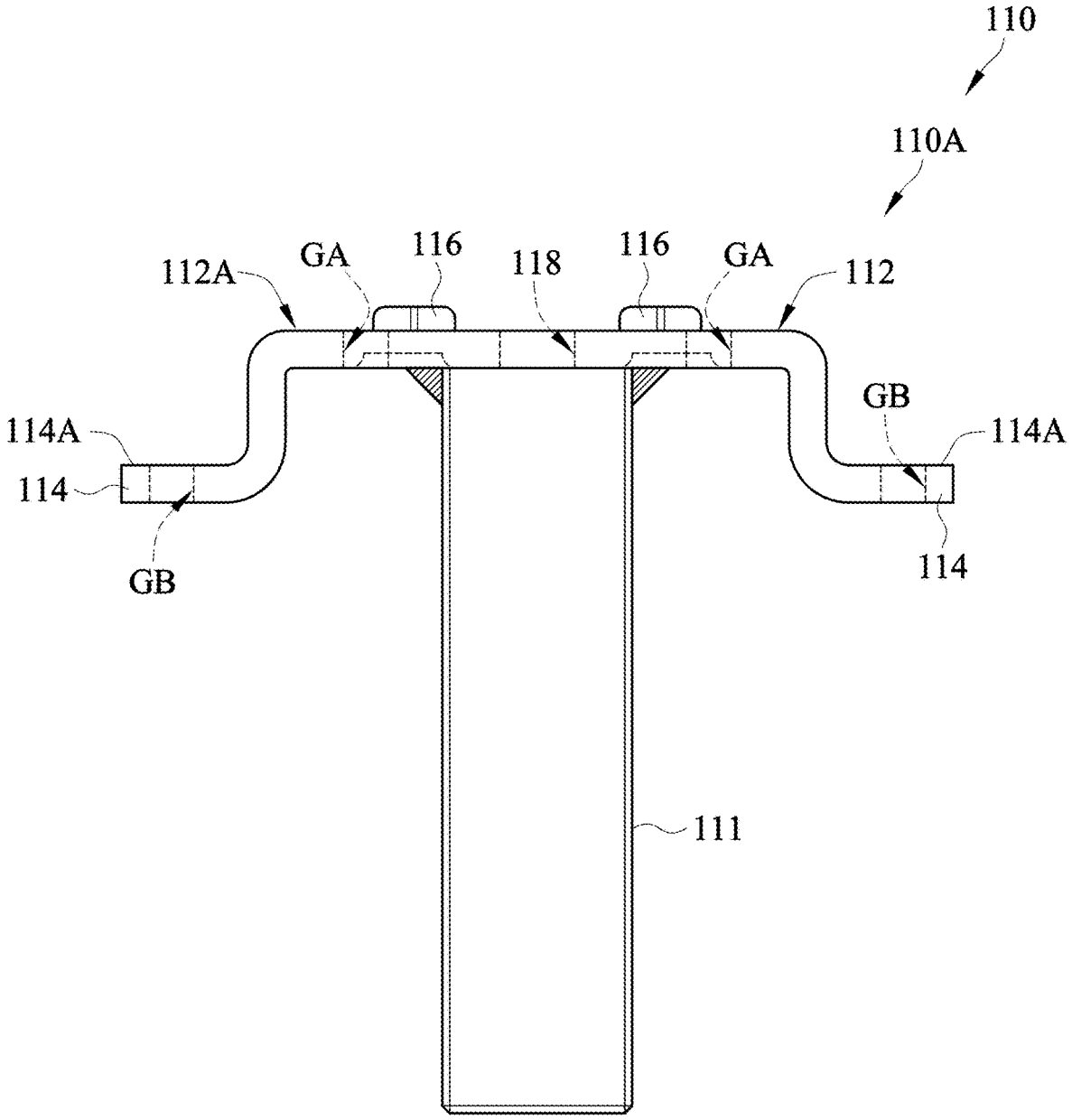
FIG. 4 illustrates a schematic lateral view of the first-type support base of the present invention.

Referring to FIG. 4, which illustrates an embodiment. The first-type support base 110A of the support base assembly 110 further has a screw rod 111, for example a threaded rod, and the screw rod 111 is disposed at a bottom portion of the base 112. The embodiment discloses that one end of the screw rod 111 is thinner, in order to insert into the central hole 118. After the screw rod 111 tightly fitting with the central hole 118, the screw rod 111 will be welded at the bottom portion of the base 112 for enhancing the strength of the support base assembly 110. Besides, obviously, the surface 114A of the first connector 114 is lower than the surface 112A of the base 112, as shown in FIG. 4.

Figure 5:
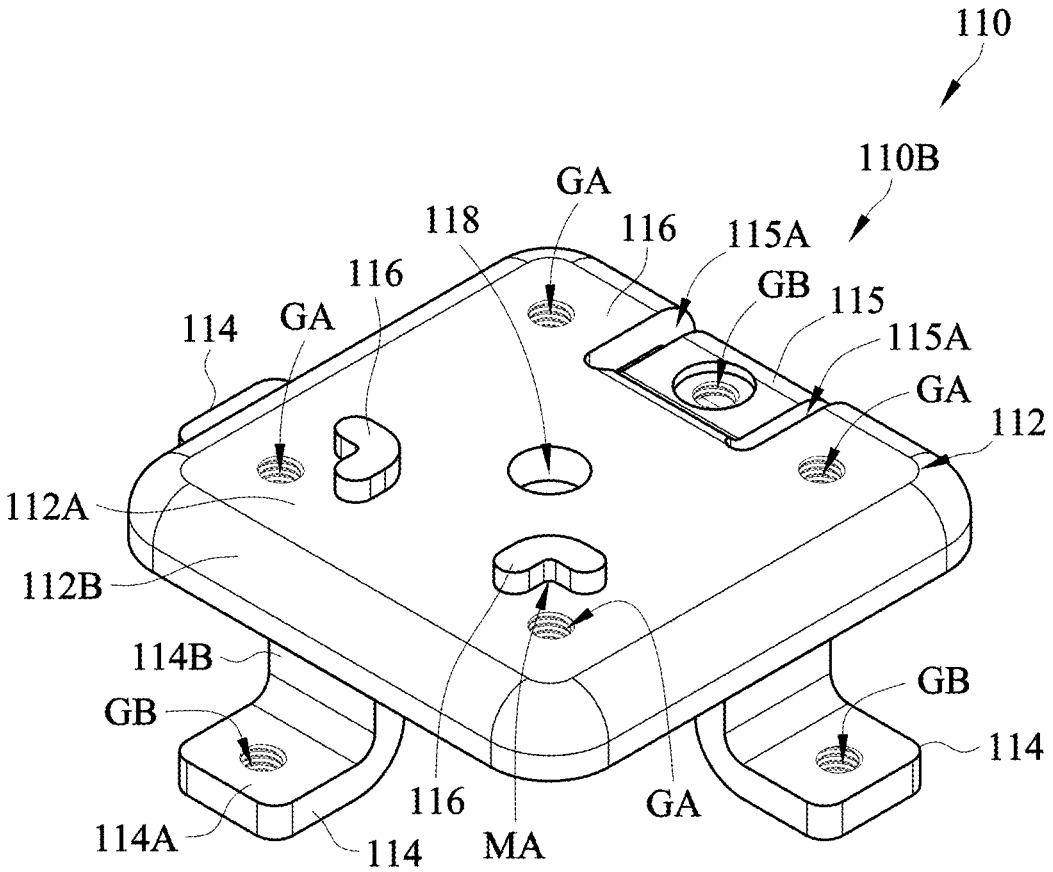
FIG. 5 illustrates a schematic 3-D view of a second-type support base of the present invention.
Figure 6:
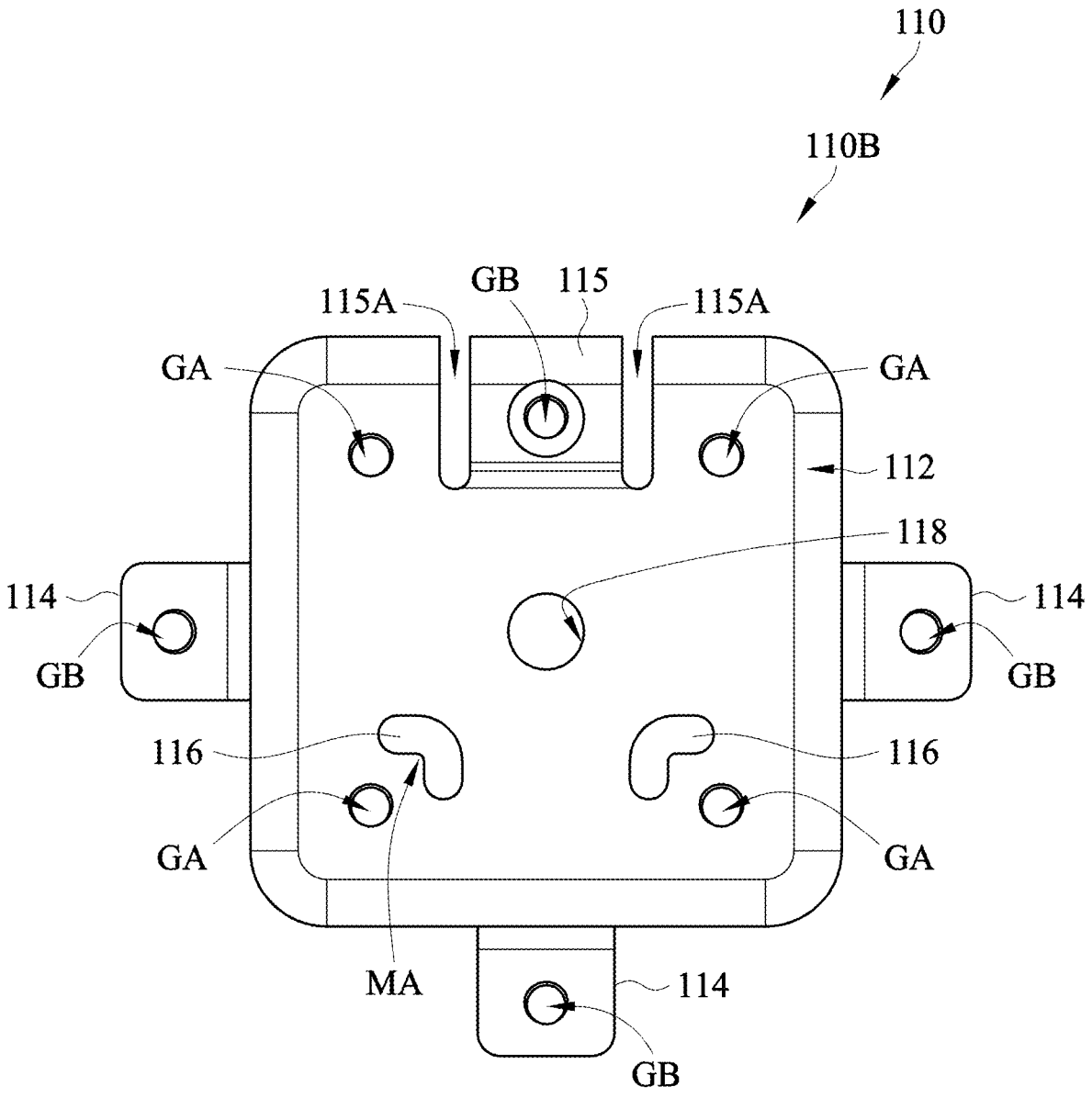
FIG. 6 illustrates a schematic top view of the second-type support base of the present invention.
Figure 7:
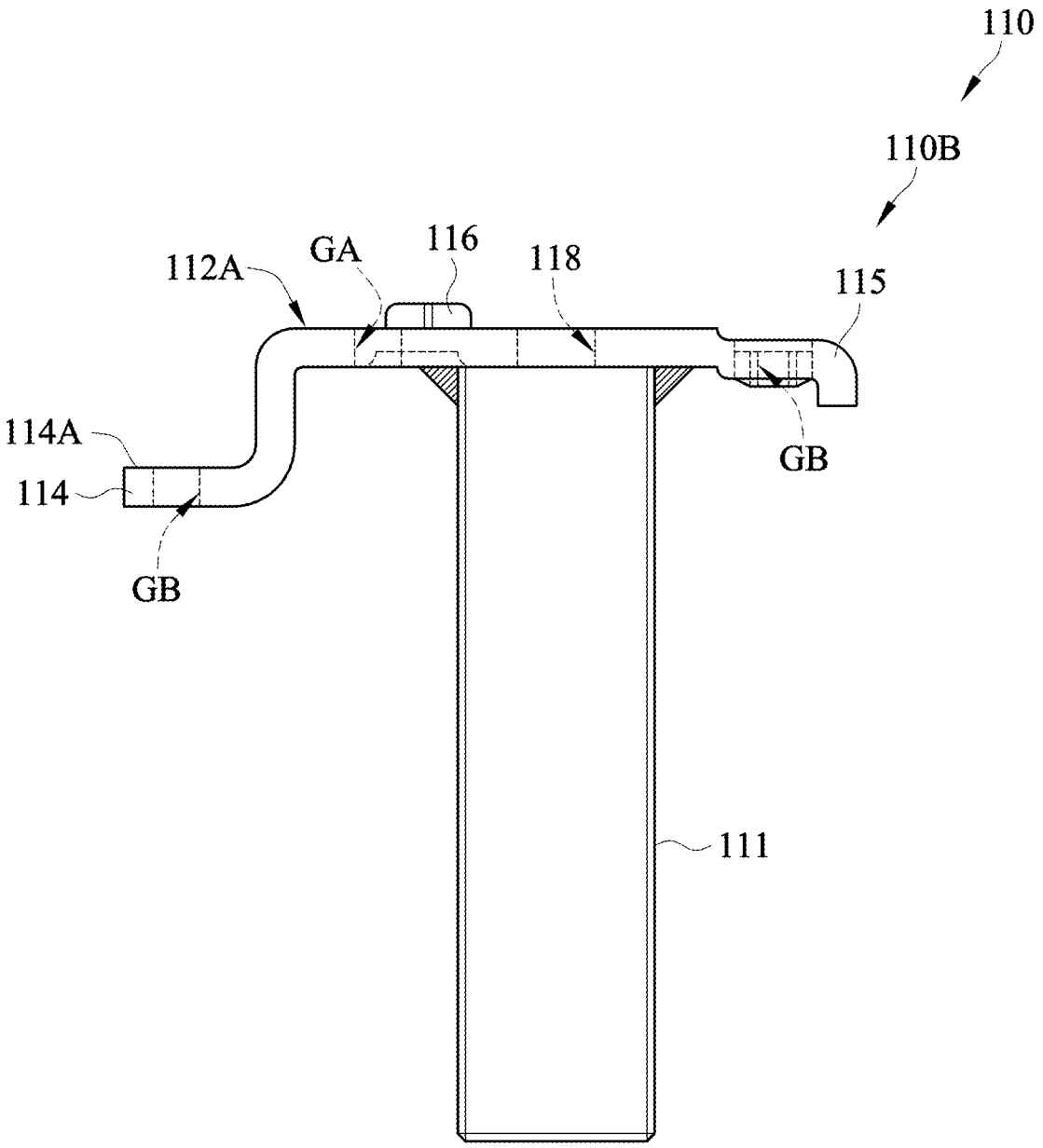
FIG. 7 illustrates a schematic lateral view of the second-type support base of the present invention.

According to FIG. 5 to FIG. 7, the second-type support bases 110B of the support base assembly 110 has the base 112, the three first connectors 114, a second connector 115, the two positioning members 116, the four floor fixing holes GA, the four crossbeam fixing holes GB, and the central hole 118. Accordingly, the differences between the second-type support base 110B and the first-type support base 110A are that of the amounts of the positioning member 116 and the first connector 114, and having the second connector 115. This is because of that, as shown in FIG. 1, the second-type support base 110B is surrounded by two side-by-side first-type floors 140A and two side-by-side second-type floors 140B, so the two positioning members 116 respectively protrude from the surface 112A of the base 112, and the two positioning members 116 are respectively adjacent to the corresponding floor fixing holes GA. Each of the positioning members 116 has the recess MA, which is provided to bear and position the first-type floor 140A, as shown in FIG. 1.

The three first connectors 114 are respectively connected with the base 112, and the second connector 115 is connected with an inside of the base 112, as shown in FIG. 5 or FIG. 7. The surface 114A of each of the three first connectors 114 is lower than the surface 112A of the base 112. Furthermore, a surface of the second connector 115 is lower than the surface 112A of the base 112, on the other hand, the surface of the second connector 115 is higher than the surface 114A of the first connector 114.

The second-type support base 110B further has an open slot 115A, and the open slot 115A is a slot for the base 112 to form a slot body. The second connector 115 is in between the two open slots 115A, that is, the two sides of the second connector 115 are the two open slots 115A respectively. The open slot 115A is used for inserting the crossbeam 120, in order to avoid interference with the floor, there is no need to provide the positioning member 116 around the open slot 115A. Each of the first connectors 114 and the second connector 115 is set a crossbeam fixing hole GB, which is for the crossbeam 120 going through, as shown in FIG. 1.

Figure 8:
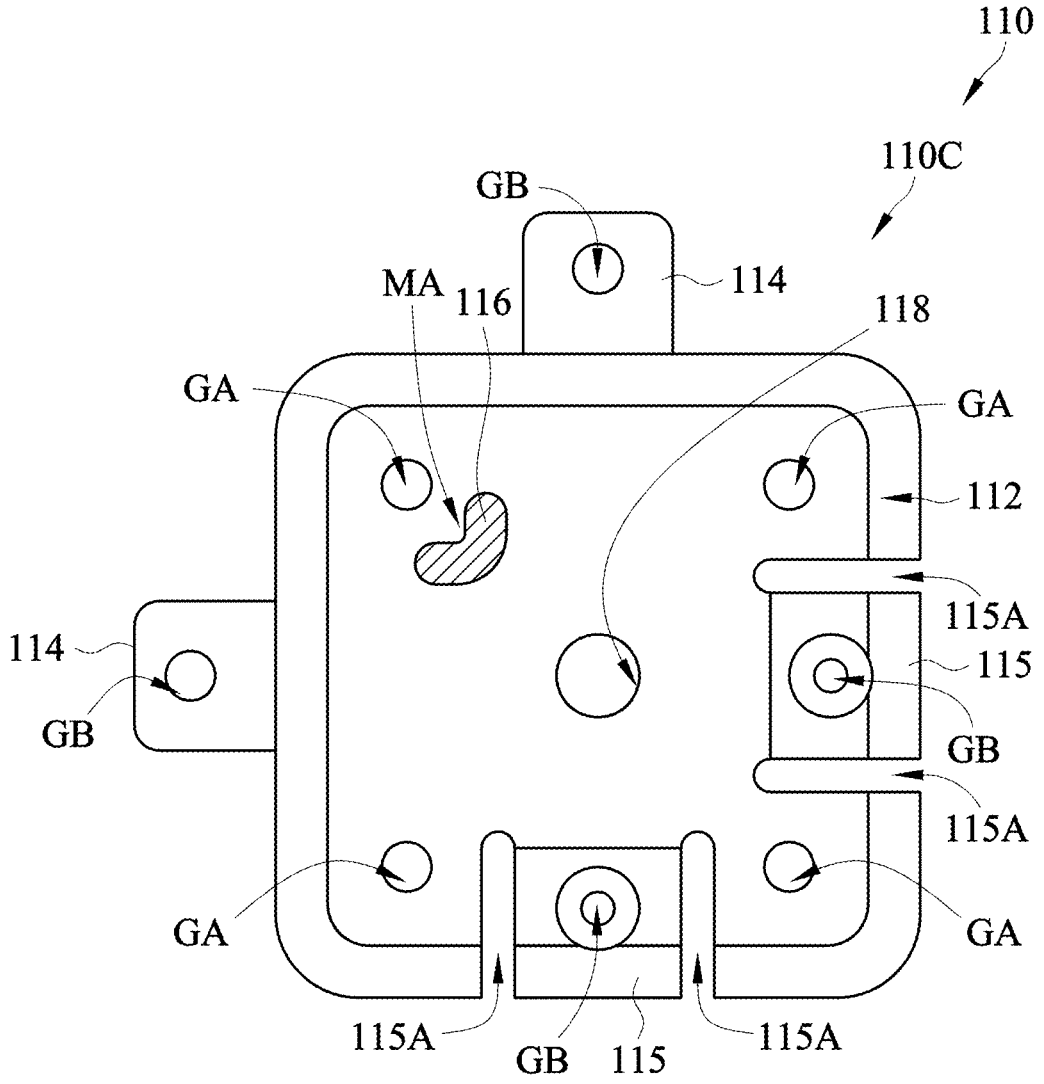
FIG. 8 illustrates a schematic top view of a third-type support base of the present invention.

In accordance with FIG. 8, that is the third-type support base 110C. The third-type support base 110C has the base 112, the two first connectors 114, the two second connectors 115, the positioning member 116, the four floor fixing holes GA, the four crossbeam fixing holes GB, and the central hole 118. Accordingly, the differences between the third-type support base 110C and the second-type support base 110B (or the first-type support base 110A) are the amounts of the positioning member 116, the first connector 114 and the second connector 115. Since the three second-type floors 140B and the first-type floor 140A are around the third-type support base 110C, the positioning member 116 protrudes out from the surface 112A of the base 112, and is adjacent the corresponding floor fixing hole GA. The positioning member 116 has the recess MA, which is provided to bear and position the first-type floor 140A, as shown in FIG. 1.

As aforementioned, based on the floors, such as the first-type floors 140A or the second-type floors 140B, to be supported, the support base assembly 110 can be provided with the first connecter 114, the second connecter 115, and the positioning member 116 correspondingly, so that it can be applied flexibly.

Figure 9:
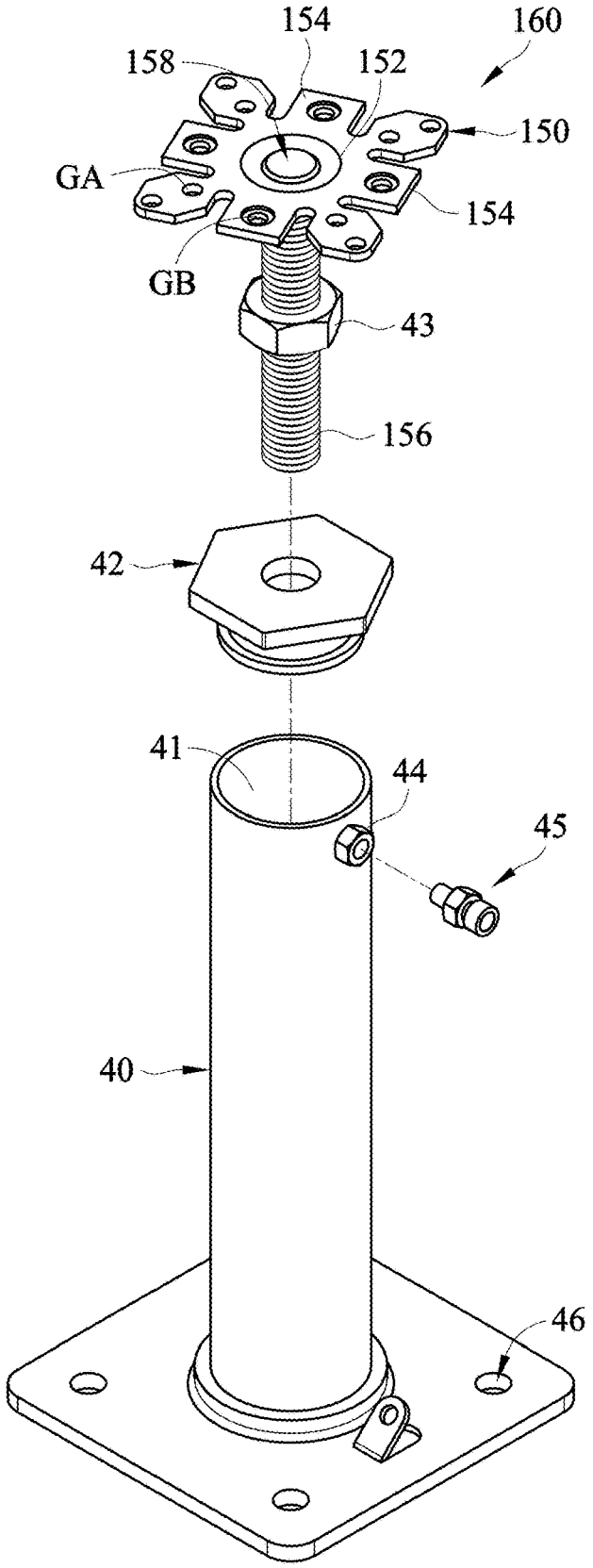
FIG. 9 illustrates a schematic exploded view of a standard support base and a base of the present invention.
Figure 10:
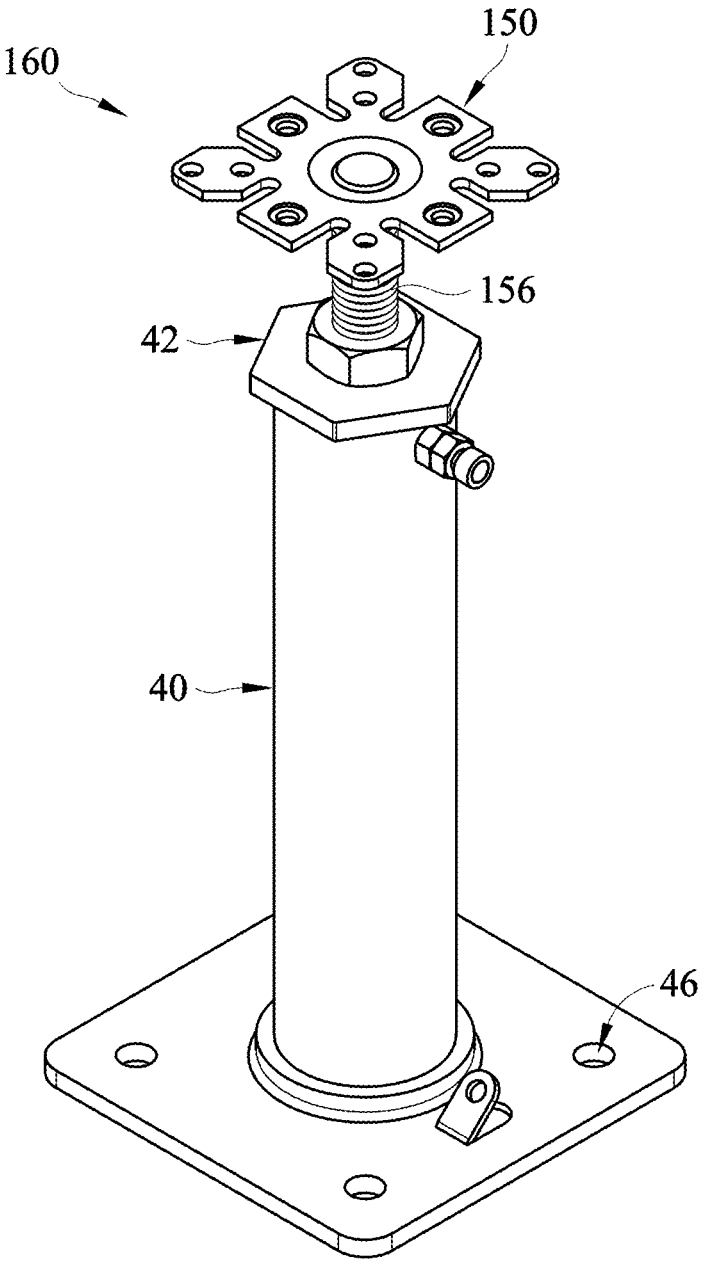
FIG. 10 illustrates a schematic view of the standard support base assembling on the base of the present invention.

With regard to FIG. 9 and FIG. 10, which illustrate a schematic exploded view of the standard support base and the base of the present invention and a schematic view of the standard support base assembling on the base of the present invention. In accordance with FIG. 9, FIG. 10 and FIG. 1, a support tripod 160 has the standard support base 150. The standard support base 150 includes a base body 152, four connecting portions 154, the four floor fixing holes GA, a central hole 158, the four crossbeam fixing holes GB, and the screw rod 156. The central hole 158 is located at a central position of the surface 112A of the base body 152 of the standard support base 150, and the central hole 158 is a hole of the base body 152. The floor fixing holes GA are respectively distributed and gone through at different positions of the base body 152 based on the central hole 158 as a center, so that the floor fixing holes GA are around the central hole 158. More, the floor fixing holes GA are holes that penetrate the base body 152 of the standard support base 150. The connecting portion 154 has the crossbeam fixing hole GB, which is for the crossbeam 20 going through, as shown in FIG. 1, in order to let the connecting portion 154 be connected with the crossbeam 20.

In addition, the screw rod 156 is distributed at a bottom portion of the base body 152, as an example, the screw rod 156 is a threaded rod. The support tripod 160 further has a bottom base 40. A bottom portion of the bottom base 40 has a plurality of fixing holes 46, in order to fix the bottom base 40 on the floor or ground. The bottom base 40 is adjustable depending on real situations. For instance, the bottom base 40 has a stand tube member 41, a pipe cover 42, a screw set 43, a locking hole 44, and a locking accessory 45, wherein the stand tube member 41 is a hollow tube with an opening, at least one locking hole 44 penetrates through a side surface of the stand tube member 41, the pipe cover 42 covers the opening of the stand tube member 41, the crew set 43 is used to cover the screw rod 156, and located above the pipe cover 42, one end of the screw rod 156 is sequentially inserted into an internal threaded hole of the pipe cover 42 and an inside of the stand tube member 41. The locking accessory 45 penetrating through and locking the locking hole 44 is able to fix the pipe cover 42. For other embodiments, the first-type support base 110A, the second-type support base 110B and the third-type support base 110C can be disposed on the bottom base 40 as well. That is, fixing the rod screw 111 in the bottom base 40 can construct a support tripod, so as to achieve the aforesaid purposes.

Figure 11:
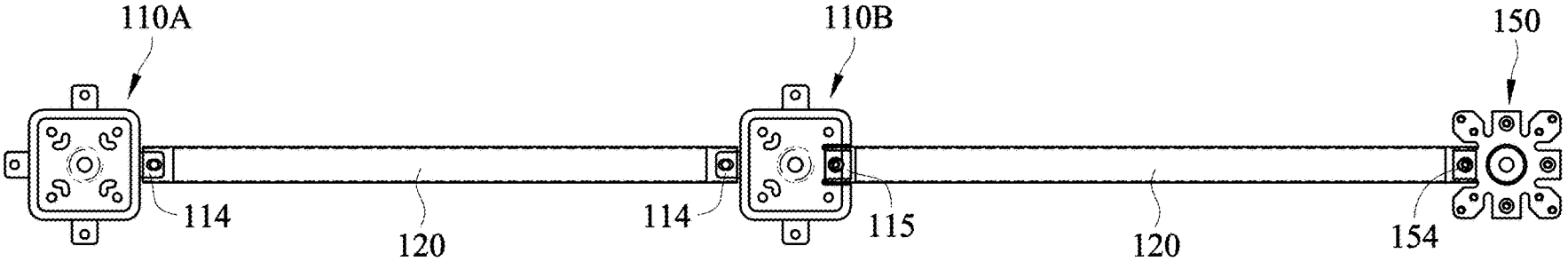
FIG. 11 illustrates a schematic view of an embodiment of the support base assemblies and crossbeams of the present invention.

With respect to FIG. 11, which illustrates a schematic view of an embodiment of the support base assemblies and the crossbeams of the present invention. As shown in FIG. 11 and FIG. 1, which take the first-type support base 110A and the second-type support base 110B as examples. The two sides of the crossbeam 120 are respectively connected with the first connector 114 of the first-type support base 110A and the first connector 114 of the second-type support base 110B; on the other hand, the two sides of the other crossbeam 120 are individually connected to the second connector 115 of the second-type support base 110B and the connecting portion 154 of the standard support base 150.

Figure 12:
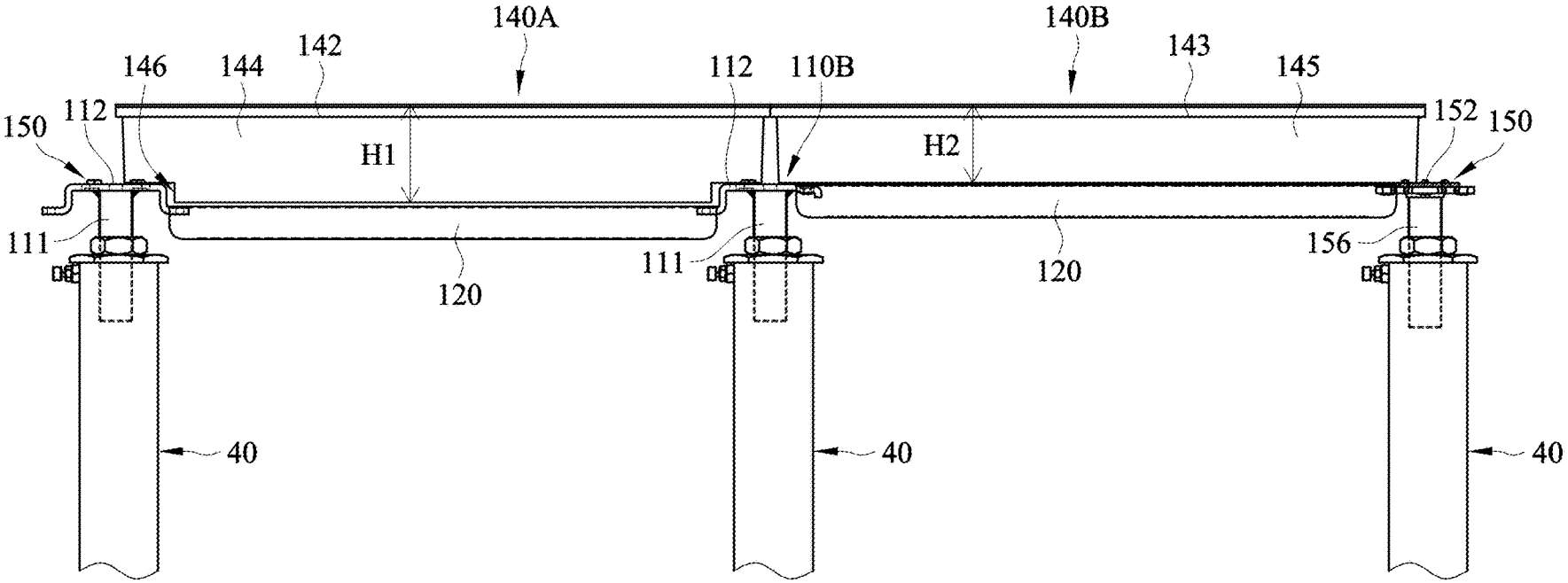
FIG. 12 illustrates a schematic lateral view of an embodiment of the support base assemblies and the crossbeams of FIG. 11 of the present invention.

Referring to FIG. 12, which illustrates a schematic lateral view of an embodiment of the support base assembly and the crossbeam of FIG. 11 of the present invention. As shown in FIG. 11 and FIG. 12, the screw rods 111, 156 are respectively fixed in the corresponding bottom bases 40, and the practical structure for the bottom bases 40 may refer to FIG. 9 and FIG. 10. Each of the four corners of the first-type floor 140A is with a groove 146, the first-type support base 110A individually bears one corner of each of the four first-type floors 140A, and the first-type floor 140A includes a first top panel 142, four first side panels 144, and four grooves 146. The first top panel 142 is disposed on the first side panels 144, and the four grooves 146 are respectively disposed at the four corners of the first-type floor 140A. Each of the four grooves 146 is located at a bottom side of each of the four first side panels 144, so that the first-type floor 140A is a grooved floor. The groove 146 urges the surface of the base 112 of the first-type support base 110A, and the first side panel 144 is on the crossbeam 120. Additionally, the second-type floor 140B includes a second top panel 143 and four second side panels 145. The second top panel is disposed on the second side panel 145, so that the second-type floor 140B is a floor without groove. The thickness H2 of the second-type floor 140B is smaller than the thickness H1 of the first-type floor 140A. A corner of a side of the second-type floor 140B directly bears the surface of the base 112 of the second-type support base 110B.

In summary, the support base assembly of the present invention can be provided with connectors and positioning members of different heights according to the different floor structures (such as thickness) to be supported, so that the assembly can be flexibly assembled to form a support device for a composite elevated floor.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A support device for a composite elevated floor, comprising:

at least one support base assembly, having a base, at least two first connectors, at least one second connector, and at least one pair of open slots, each first connector being respectively disposed outside a periphery of the base, a surface of each first connector being lower than a bottom surface of the base, each second connector is disposed within the periphery of the base between a corresponding pair of open slots, one surface of the at least one second connector being lower than an upper surface of the base and higher than the surface of each first connector;

a plurality of crossbeams, wherein at least two first connectors and the at least one second connector connecting with a respective one of the plurality of crossbeams;

at least one floor of a first type disposed in a first area, four corners of each of floor of a first type having a groove conforming to the surface of the base and the surface of the first connector; and a plurality of floors of a second type in a second area, the second area being on the periphery of the first area, each corner of the floors of a second type conforming to the upper surface of the base and the one surface of the at least one second connector.

2. The support device for the composite elevated floor according to claim 1, wherein the at least one support base assembly comprises at least one positioning member, which protrudes out from the upper surface of the base, the at least one positioning member positioning the at least one floor of a first type.

3. The support device for the composite elevated floor according to claim 2, wherein the at least one support base assembly comprises a plurality of floor fixing holes that penetrate through the base, the at least one positioning member being adjacent to a corresponding floor fixing hole.

4. The support device for the composite elevated floor according to claim 3, wherein the at least one support base assembly comprises a central hole and a screw rod, the central hole penetrating through the base, each of the floor fixing holes being located proximal to a respective corner of the base and the central hole, one end of the screw rod being inserted into the central hole and disposed at a bottom portion of the base.

5. The support device for the composite elevated floor according to claim 1, wherein the at least one support base assembly includes three first connectors and a single second connector, respectfully connecting to two floors of a first type and two floors of a second type.

6. The support device for the composite elevated floor according to claim 5, wherein the at least one support base assembly further comprises a plurality of positioning members protruding from the upper surface of the base.

7. The support device for the composite elevated floor according to claim 1, wherein the at least one support base assembly further comprises a plurality of positioning members protruding from the upper surface of the base.

8. The support device for the composite elevated floor according to claim 6, wherein the at least one support base assembly comprises two positioning members protruding out from the upper surface of the base.

9. The support device for the composite elevated floor according to claim 1, wherein the at least one support base assembly includes two first connectors and two second connectors, respectfully connecting to a single floor of a first type and three floors of a second type.

10. The support device for the composite elevated floor according to claim 9, wherein the at least one support base assembly comprises a single positioning member protruding from the upper surface of the base.

11. The support device for the composite elevated floor according to claim 1, wherein the at least one support base assembly further comprises a bottom base, comprising a stand tube member, a pipe cover, a screw set, a locking hole, and a locking accessory, wherein the stand tube member is a hollow tube with an opening, one end of a screw rod of the at least one support base assembly is inserted into an internal threaded hole of the pipe cover, and a portion of the pipe cover is inserted into the opening and positioned inside of the stand tube member.

* * * * *